US008104616B2

(12) United States Patent
Dalea et al.

(10) Patent No.: US 8,104,616 B2
(45) Date of Patent: Jan. 31, 2012

(54) CLAMSHELL PACKAGE FOR HOLDING AND DISPLAYING CONSUMER PRODUCTS

(75) Inventors: Gregory Peter Dalea, Hamilton, OH (US); Gary Allen Wessling, Erlanger, KY (US); Gregory Alan Walters, Oak Harbor, OH (US); Kent David Johnson, Port Clinton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 3 days.

(21) Appl. No.: 11/703,286

(22) Filed: Feb. 7, 2007

(65) Prior Publication Data

US 2007/0187274 A1 Aug. 16, 2007

Related U.S. Application Data

(60) Provisional application No. 60/772,650, filed on Feb. 11, 2006.

(51) Int. Cl.
*B65D 65/00* (2006.01)

(52) U.S. Cl. ..... 206/427; 206/471; 206/775; 206/470; 206/779; 206/429

(58) Field of Classification Search ..... 206/471, 206/461, 446, 470, 775, 779, 427, 199, 429; 220/4.21, 4.22, 4.23, 4.24
See application file for complete search history.

(56) References Cited

U.S. PATENT DOCUMENTS 2,020,454 A * 11/1935 Bisbee et al. ..... 217/21
2,438,091 A 3/1948 Lynch
2,528,378 A 10/1950 Mannheimer
2,658,072 A 11/1953 Kosmin
2,798,053 A 7/1957 Brown
2,986,271 A * 5/1961 Forrer ..... 206/427
3,455,440 A * 7/1969 West ..... 206/779
3,479,429 A 11/1969 Morshauser et al.
3,533,955 A 10/1970 Pader et al.

(Continued)

FOREIGN PATENT DOCUMENTS

CA 2246316 A1 6/1998

(Continued)

OTHER PUBLICATIONS

International Search Report, PCT/IB2007/050437, dated Jun. 21, 2007 (8 pages).

(Continued)

*Primary Examiner* — J. Gregory Pickett
*Assistant Examiner* — Andrew Perreault
(74) *Attorney, Agent, or Firm* — Mark A. Charles

(57) ABSTRACT

A clamshell package is provided for holding and displaying a consumer product that comprises a bottle and a cap. The clamshell package comprises a first clamshell side and a second clamshell side, wherein at least a portion of the first and second clamshell sides are affixed together to hold the consumer product between the first and second clamshell sides. The clamshell package further comprises an aperture through which at least a portion of the cap of the consumer product extends from the clamshell package. The clamshell package is therefore able to hold and display the consumer product, while allowing a consumer to access the cap of the product in order to smell or to sample the product. A clamshell package is further provided for holding and displaying a consumer product comprising liquid composition contained in a tottle.

15 Claims, 5 Drawing Sheets

U.S. PATENT DOCUMENTS 3,542,256 A * 11/1970 Waterman ..... 222/484
3,615,972 A 10/1971 Morehouse, Jr. et al.
3,618,757 A * 11/1971 Funkhouser ..... 206/194
3,800,998 A * 4/1974 Gask ..... 229/406
3,850,365 A * 11/1974 Dietrich ..... 206/427
3,899,076 A * 8/1975 Florian ..... 206/427
3,929,678 A 12/1975 Laughlin et al.
3,937,811 A 2/1976 Papantoniou et al.
3,951,679 A 4/1976 Bernhard et al.
3,980,767 A 9/1976 Chown et al.
4,159,028 A 6/1979 Barker et al.
4,263,363 A 4/1981 Buck et al.
4,335,103 A 6/1982 Barker et al.
4,379,753 A 4/1983 Bolich, Jr.
4,387,090 A 6/1983 Bolich, Jr.
4,425,322 A 1/1984 Harvey et al.
4,509,949 A 4/1985 Huang et al.
4,518,578 A 5/1985 Hayes et al.
D292,879 S * 11/1987 Smith ..... D9/753
4,705,681 A 11/1987 Maes et al.
4,818,575 A 4/1989 Hirata et al.
4,899,877 A 2/1990 Kiernan
4,966,205 A 10/1990 Tanaka
4,980,155 A 12/1990 Shah et al.
5,002,680 A 3/1991 Schmidt et al.
5,011,690 A 4/1991 Garvey et al.
5,052,557 A 10/1991 Contino et al.
5,059,414 A 10/1991 Dallal et al.
5,087,445 A 2/1992 Haffey et al.
5,223,315 A 6/1993 Katsura et al.
5,228,912 A 7/1993 Herget et al.
5,248,495 A 9/1993 Patterson et al.
RE34,584 E 4/1994 Grote et al.
5,304,334 A 4/1994 Lahanas et al.
5,393,450 A 2/1995 Shana'a
5,451,396 A 9/1995 Villars
5,455,035 A 10/1995 Guerrero et al.
5,487,168 A 1/1996 Geiner et al.
5,487,884 A 1/1996 Bissett et al.
5,530,054 A 6/1996 Tse et al.
5,540,853 A 7/1996 Trinh et al.
5,556,628 A 9/1996 Derian et al.
5,578,299 A 11/1996 Starch
5,612,307 A 3/1997 Chambers et al.
5,632,420 A * 5/1997 Lohrman et al. ..... 222/212
5,635,171 A 6/1997 Nadaud
5,652,228 A 7/1997 Bissett
5,661,189 A 8/1997 Grieveson et al.
5,681,852 A 10/1997 Bissett
5,687,779 A 11/1997 Andersson et al.
5,716,920 A 2/1998 Glenn et al.
5,851,978 A 12/1998 Shana'a
5,873,494 A * 2/1999 Dallas, Jr. ..... 222/129
5,885,948 A 3/1999 Glenn, Jr. et al.
5,914,117 A 6/1999 Lavaud
5,925,603 A 7/1999 D'Angelo
5,929,019 A 7/1999 Puvvada et al.
5,932,203 A 8/1999 Coffindaffer et al.
5,935,561 A 8/1999 Inman et al.
5,947,335 A 9/1999 Milio et al.
5,952,286 A 9/1999 Puvvada et al.
5,954,213 A * 9/1999 Gerhart et al. ..... 215/10
5,965,500 A 10/1999 Puvvada
5,965,501 A 10/1999 Rattinger et al.
6,051,541 A 4/2000 Neuser et al.
D426,158 S * 6/2000 Flurer et al. ..... D9/449
6,080,707 A 6/2000 Glenn, Jr. et al.
6,114,290 A 9/2000 Lyle et al.
6,174,845 B1 1/2001 Rattinger et al.
6,176,391 B1 1/2001 Rehkemper et al.
6,176,395 B1 1/2001 Abbott et al.
6,190,648 B1 2/2001 Kouzu et al.
6,194,364 B1 2/2001 Glenn, Jr.
D438,460 S * 3/2001 Hammond ..... D9/753
D439,165 S * 3/2001 Erckelbout et al. ..... D9/520
6,213,166 B1 4/2001 Thibiant et al.
D441,645 S * 5/2001 Longhurst ..... D9/415
6,232,496 B1 5/2001 Carr et al.
6,245,323 B1 6/2001 Christie et al.
6,245,344 B1 6/2001 Thibiant et al.
6,255,264 B1 7/2001 Fleurot et al.
6,267,978 B1 7/2001 Sang et al.
6,268,322 B1 7/2001 St. Lewis et al.
6,294,179 B1 9/2001 Lee et al.
6,306,806 B1 10/2001 St. Lewis et al.
6,335,312 B1 1/2002 Coffindaffer et al.
6,340,723 B1 1/2002 Nitta et al.
6,362,156 B1 3/2002 Hsu et al.
D455,655 S * 4/2002 Bunce ..... D9/521
6,367,519 B2 4/2002 Thibiant et al.
6,383,999 B1 5/2002 Coyle et al.
6,385,992 B1 * 5/2002 Flore, Jr. ..... 62/457.9
6,394,323 B2 * 5/2002 McClean et al. ..... 222/534
6,395,691 B1 5/2002 Tsaur
6,419,783 B1 * 7/2002 Rainey et al. ..... 156/297
6,426,326 B1 7/2002 Mitra et al.
6,429,177 B1 8/2002 Williams et al.
6,491,932 B1 12/2002 Ramin et al.
6,495,498 B2 12/2002 Niemiec et al.
6,506,391 B1 1/2003 Biatry
6,516,838 B2 2/2003 Thibiant et al.
6,517,939 B1 2/2003 Moini et al.
6,521,216 B1 2/2003 Glandorf et al.
6,533,873 B1 3/2003 Margosiak et al.
6,534,456 B2 3/2003 Hayward et al.
6,534,457 B2 3/2003 Mitra
6,547,063 B1 4/2003 Zaveri et al.
6,555,509 B2 4/2003 Abbas et al.
6,564,978 B1 * 5/2003 Safian et al. ..... 222/534
6,574,985 B2 * 6/2003 Fiore, Jr. ..... 62/457.9
6,589,509 B2 7/2003 Keller et al.
6,645,511 B2 11/2003 Aronson et al.
6,652,134 B2 * 11/2003 Lloyd ..... 366/130
6,663,855 B2 12/2003 Frechet et al.
6,673,371 B2 1/2004 Brown et al.
6,673,755 B2 1/2004 Wei et al.
6,682,726 B2 1/2004 Marchesi et al.
D486,395 S * 2/2004 Lovell et al. ..... D9/521
D486,398 S * 2/2004 Lovell et al. ..... D9/529
6,691,394 B1 * 2/2004 McClean ..... 29/434
6,695,510 B1 2/2004 Look et al.
6,699,488 B2 3/2004 Deckner et al.
6,759,376 B2 7/2004 Zhang et al.
6,764,991 B2 7/2004 Puvvada et al.
6,773,811 B2 8/2004 Ferguson et al.
6,780,826 B2 8/2004 Zhang et al.
6,787,511 B2 9/2004 Patel et al.
6,797,683 B2 9/2004 Shana'a et al.
6,903,057 B1 6/2005 Tsaur
6,924,256 B2 8/2005 Massaro et al.
7,143,893 B2 12/2006 Kelly
7,144,542 B2 12/2006 Holzer et al.
7,273,837 B2 9/2007 Boutique et al.
7,524,807 B2 4/2009 Clapp et al.
7,537,819 B2 5/2009 Hendricks
7,666,825 B2 2/2010 Wagner et al.
2001/0035230 A1 11/2001 Thibiant et al.
2001/0036467 A1 11/2001 Thibiant et al.
2002/0004468 A1 1/2002 Hodge et al.
2002/0010110 A1 1/2002 Hayward et al.
2003/0003069 A1 1/2003 Carson et al.
2003/0049282 A1 3/2003 Aaronson et al.
2003/0054019 A1 3/2003 Aronson et al.
2003/0068287 A1 4/2003 Ansara et al.
2003/0152540 A1 8/2003 Putman et al.
2003/0161852 A1 8/2003 Miller et al.
2003/0180246 A1 9/2003 Frantz et al.
2003/0192787 A1 * 10/2003 Kelly ..... 206/145
2003/0222100 A1 12/2003 Husband et al.
2004/0033914 A1 2/2004 Patel et al.
2004/0048757 A1 3/2004 Zhang et al.
2004/0048758 A1 3/2004 Zhang et al.
2004/0057920 A1 3/2004 Focht et al.
2004/0058920 A1 3/2004 Jover et al.
2004/0091445 A1 5/2004 Dykstra et al.
2004/0092415 A1 5/2004 Focht et al.
2004/0105827 A1 6/2004 Grimm et al.

| | | | |
|---|---|---|---|
| 2004/0146475 | A1 | 7/2004 | Peffly et al. |
| 2004/0158940 | A1 | 8/2004 | Wells et al. |
| 2004/0180020 | A1 | 9/2004 | Manelski et al. |
| 2004/0219119 | A1 | 11/2004 | Wei et al. |
| 2004/0223929 | A1 | 11/2004 | Clapp et al. |
| 2004/0223939 | A1 | 11/2004 | Clausen et al. |
| 2004/0223991 | A1 | 11/2004 | Wei et al. |
| 2004/0232023 | A1* | 11/2004 | Bansal et al. ..... 206/427 |
| 2004/0235693 | A1 | 11/2004 | Wei et al. |
| 2004/0242706 | A1 | 12/2004 | Wiersema et al. |
| 2004/0248748 | A1 | 12/2004 | Wei et al. |
| 2004/0248749 | A1 | 12/2004 | Mitra et al. |
| 2005/0003975 | A1 | 1/2005 | Browne et al. |
| 2005/0020468 | A1 | 1/2005 | Frantz et al. |
| 2005/0100570 | A1 | 5/2005 | Wei et al. |
| 2005/0139574 | A1 | 6/2005 | Simone et al. |
| 2005/0143269 | A1 | 6/2005 | Wei et al. |
| 2005/0191449 | A1 | 9/2005 | Funato et al. |
| 2005/0192187 | A1 | 9/2005 | Wagner et al. |
| 2005/0192188 | A1 | 9/2005 | Wagner et al. |
| 2005/0192189 | A1 | 9/2005 | Wagner et al. |
| 2005/0238680 | A1 | 10/2005 | Stella et al. |
| 2005/0249758 | A1 | 11/2005 | Di Puccio Pagano |
| 2005/0269372 | A1 | 12/2005 | Smith |
| 2005/0276768 | A1 | 12/2005 | Wei et al. |
| 2006/0002880 | A1 | 1/2006 | Peffly et al. |
| 2006/0008438 | A1 | 1/2006 | Velarde et al. |
| 2006/0079420 | A1 | 4/2006 | Wagner et al. |
| 2006/0102654 | A1 | 5/2006 | Seys et al. |
| 2006/0118139 | A1 | 6/2006 | Fausnight et al. |
| 2006/0182699 | A1 | 8/2006 | Tayor et al. |
| 2006/0191589 | A1 | 8/2006 | McCall et al. |
| 2006/0252662 | A1 | 11/2006 | Soffin et al. |
| 2006/0276357 | A1 | 12/2006 | Smith et al. |
| 2007/0072781 | A1 | 3/2007 | Soffin et al. |
| 2007/0155637 | A1 | 7/2007 | Smith, III et al. |
| 2007/0163990 | A1 | 7/2007 | Escobosa et al. |
| 2007/0167338 | A1 | 7/2007 | McHugh et al. |
| 2007/0248562 | A1 | 10/2007 | Berry et al. |
| 2007/0280976 | A1 | 12/2007 | Taylor et al. |

FOREIGN PATENT DOCUMENTS

| | | | |
|---|---|---|---|
| CH | 678488 | A5 | 9/1991 |
| DE | 19650952 | A1 | 6/1998 |
| DE | 19854086 | A1 | 5/2000 |
| EP | 0056219 | A1 | 7/1982 |
| EP | 0078138 | A2 | 5/1983 |
| EP | 0112807 | A2 | 7/1984 |
| EP | 0320473 | A1 | 6/1989 |
| EP | 0348372 | A2 | 12/1989 |
| EP | 0331617 | B1 | 4/1992 |
| EP | 0486080 | A2 | 5/1992 |
| EP | 1064918 | A1 | 1/2001 |
| EP | 1108421 | A2 | 6/2001 |
| EP | 1005849 | B1 | 9/2001 |
| EP | 1174360 | A1 | 1/2002 |
| EP | 0907345 | B1 | 5/2003 |
| EP | 1529517 | A2 | 5/2005 |
| GB | 1277324 | A | 6/1972 |
| GB | 2310398 | A | 8/1997 |
| JP | 02184884 | | 7/1990 |
| JP | 05254528 | | 10/1993 |
| JP | 2000-229817 | A | 8/2000 |
| JP | 2002-128639 | A | 5/2002 |
| JP | 2002-138010 | A | 5/2002 |
| WO | WO-90/13283 | A1 | 11/1990 |
| WO | WO-92/12212 | A1 | 7/1992 |
| WO | WO-94/10973 | A1 | 5/1994 |
| WO | WO-97/17938 | A1 | 5/1997 |
| WO | WO-98/27193 | A1 | 6/1998 |
| WO | WO-99/09952 | A1 | 3/1999 |
| WO | WO-99/38489 | A1 | 8/1999 |
| WO | WO-99/38491 | A1 | 8/1999 |
| WO | WO-00/75240 | A1 | 12/2000 |
| WO | WO-01/01931 | A2 | 1/2001 |
| WO | WO 01/23517 | A1 | 4/2001 |
| WO | WO-01/64180 | A1 | 9/2001 |
| WO | WO-01/70193 | A2 | 9/2001 |
| WO | WO-01/70926 | A1 | 9/2001 |
| WO | WO-02/100358 | A1 | 12/2002 |
| WO | WO-03/055456 | A1 | 7/2003 |
| WO | WO-03/105796 | A1 | 12/2003 |
| WO | WO-2004/018609 | A1 | 3/2004 |
| WO | WO-2004/026276 | A1 | 4/2004 |
| WO | WO-2004/050055 | A1 | 6/2004 |
| WO | WO-2004/083351 | A1 | 9/2004 |
| WO | WO-2004/096162 | A2 | 11/2004 |
| WO | WO-2004/098559 | A2 | 11/2004 |
| WO | WO-2004/100919 | A1 | 11/2004 |
| WO | WO-2005/048959 | A1 | 6/2005 |
| WO | WO-2005/065638 | A1 | 7/2005 |
| WO | WO-2005/067875 | A1 | 7/2005 |
| WO | WO-2005/084614 | A1 | 9/2005 |
| WO | WO-2005/084616 | A1 | 9/2005 |
| WO | WO-2005/123031 | A1 | 12/2005 |

OTHER PUBLICATIONS

C.D. Vaughan, "Solubility, Effects in Product, Package, Penetration and Preservation," Cosmetics and Toiletries, vol. 103, Oct. 1988.

Crank, Mathematics of Duffusion, 2nd Edition, p. 63.

CTFA International Cosmetic Ingredient Dictionary, Fourth Edition, 1991, pp. 12 and 80.

Household Products Database, Brand Information, "Olay Daily Renewal Moisturizing Body Wash, Calming," [Online] URL: http://householdproducts.nlm.nih.gov/cgi-bin/household/brands?tbl=brands&id=16003084, accessed Feb. 8, 2006 (2 pages).

Milton, Introduction to Probability and Statistics, 4th Edition, p. 317 (Section 9.2: Testing Hypotheses on a Proportion).

XP002332778 "Dove All Day Moisturizing Body Wash" [Online] URL: http://www.ewg.org/reports/skindeep2/report/pht?type—PRODUCT&id=8801874, accessed Feb. 8, 2006 (6 pages).

J. Caelles et al., "Anionic and Cationic Compounds in Mixed Systems, "Cosmetics & Toiletries, vol. 106, Apr. 1991. pp. 49-54.

C.J. van Oss, "Coacervation, Complex-Coacervation and Flocculation," J. Dispersion Science and Technology, vol. 9 (5, 6), 1988-89, p. 561-573.

D.J. Burgess, "Practical Analysis of Complex Coacervate Systems," J. of Colloid Anti Interface Science, vol. 140, No. 1, Nov. 1990, pp. 227-238.

Milton, Introduction to Probability and Statistics, 4th Edition p. 317 (Section 9.2: Testing Hypotheses on a Proportion).

C.D. Vaughan, "Solubility, Effects in Product, in Package, Penetration and Preservation," Cosmetic and Toiletries, vol. 103, Oct. 1988.

KOBO Brochure, "Treated Pigments" (May 2000).

U.S. Appl. No. 12/887,326, filed Sep. 21, 2010, Soffin et al.

U.S. Appl. No. 12/814,307, filed Jun. 11, 2010, Wei et al.

U.S. Appl. No. 12/904,842, filed Oct. 14, 2010, Focht.

* cited by examiner

CLAMSHELL PACKAGE FOR HOLDING AND DISPLAYING CONSUMER PRODUCTS

CROSS REFERENCE TO RELATED APPLICATION

This application claims the benefit of U.S. Provisional Application No. 60/772,650, filed Feb. 11, 2006.

FIELD OF THE INVENTION

The present invention generally relates to packages for containing and displaying consumer products and, more specifically, to so-called clamshell packages having two sides typically formed of thermoplastic material and affixed together to hold and display the consumer product.

BACKGROUND OF THE INVENTION

Clamshell or blister pack packaging is a very popular type of packaging for many consumer products, including electrical and electronic products, such as portable compact disc players, cassette recorders or players and other portable audio or video products. Quite often, the clamshell packaging is designed to be theft resistant while also enabling the product design and features to be clearly displayed to the consumer at the retail level.

However, such clamshell packaging has not typically been used to hold and display personal care and household care products, including scented products such as shampoos, hair conditioners, body washes, skin lotions, deodorants, laundry detergents, fabric softeners, and the like. Consumers in retail stores have a tendency to want to interact with personal care and household care products, such as smelling a scented personal care product, and clamshell packages tend to isolate the product from the consumer thereby preventing this type of interaction.

Oftentimes, a consumer product is packaged in a so-called tottle package. Examples include products used in the shower such as shampoo, hair conditioner, and liquid body wash. One drawback of consumer products packaged in tottles is that the products can be susceptible to leakage on a store shelf if the cap of the product is not closed tightly.

There has thus been a desire to develop a clamshell package that can effectively hold and display a consumer product, especially a scented consumer product, that allows a consumer to interact with the consumer product, such as by smelling the consumer product, without having to open the clamshell package. There has been a further desire to develop a secondary package that can hold and display a consumer product packaged in a tottle that further prevents leakage of the consumer product onto store shelves.

SUMMARY OF THE INVENTION

The present invention relates to a clamshell package for holding and displaying a consumer product that comprises a bottle and a cap. The clamshell package comprises a first clamshell side and a second clamshell side, wherein at least a portion of the first and second clamshell sides are affixed together to hold the consumer product between the first and second clamshell sides. The clamshell package further comprises an aperture through which at least a portion of the cap of the consumer product extends from the clamshell package. The clamshell package is therefore able to hold and display the consumer product, while allowing a consumer to access the cap of the product. The consumer is then able to open the cap of the consumer product in order to smell or to sample the product.

The present invention further relates to a clamshell package for holding and displaying a consumer product comprising a tottle containing a liquid composition. The clamshell package comprises a first clamshell side and a second clamshell side wherein at least a portion of the first and second clamshell sides are affixed together to hold the consumer product and to prevent leakage of the liquid composition from the clamshell package. In this respect of the invention, a tottle containing a liquid composition can be displayed on a store shelf without concern of the liquid composition leaking onto the store shelves.

The clamshell packages of the present invention can be utilized to hold and display a plurality of consumer products in a single clamshell package.

DETAILED DESCRIPTION OF THE INVENTION

Figure 1:
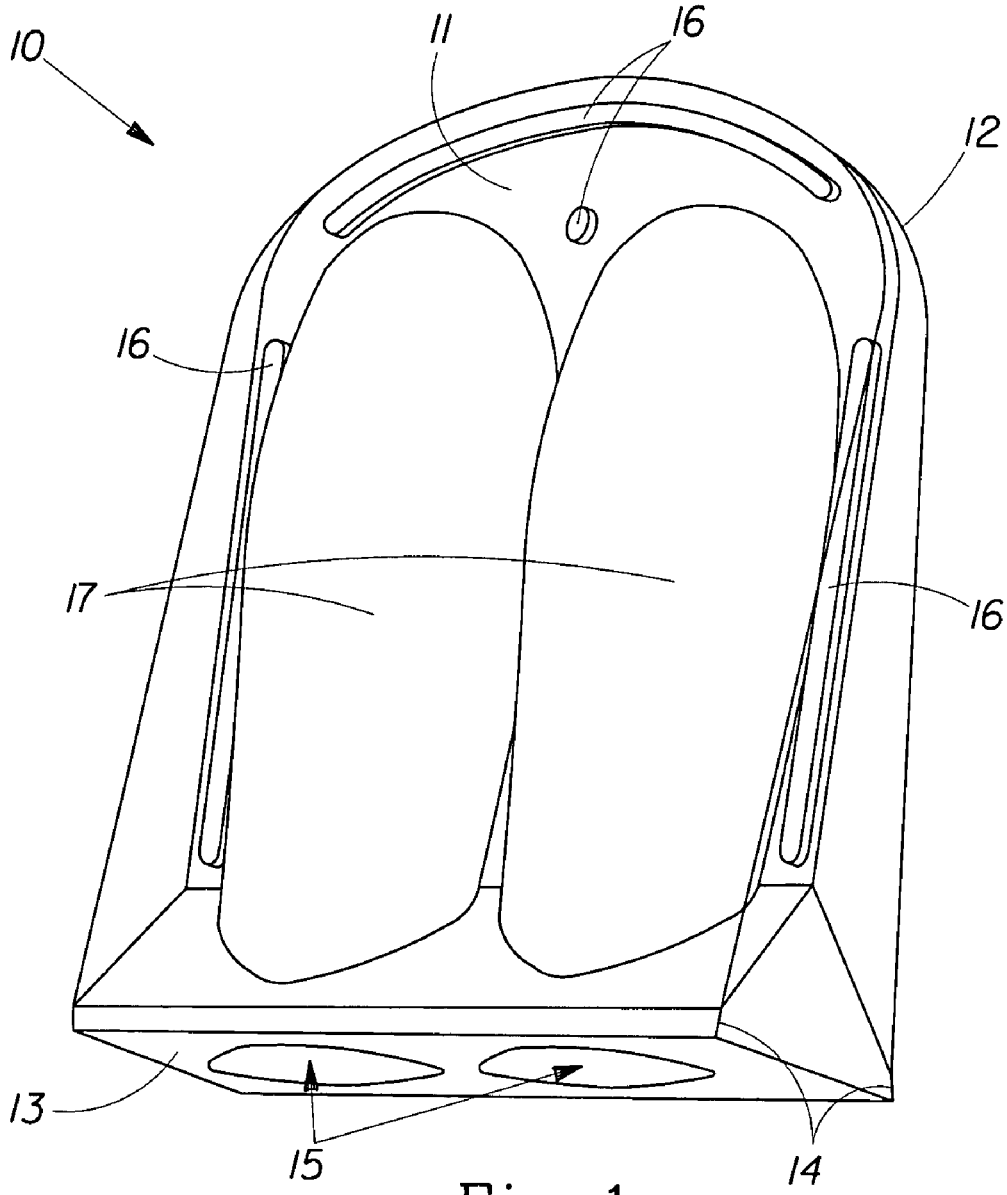
FIG. 1 is a perspective view of one embodiment of a clamshell package according to the present invention.
Figure 2:
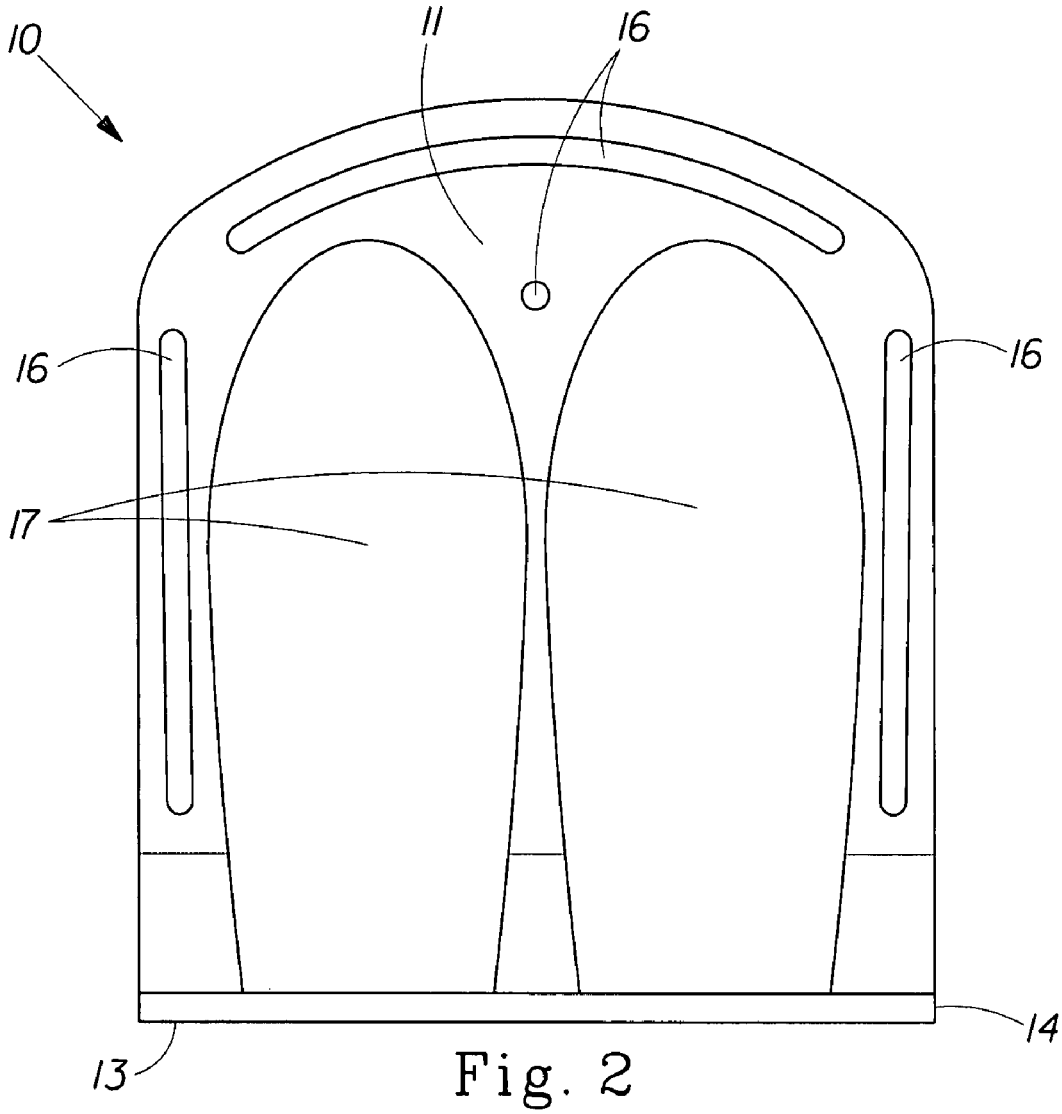
FIG. 2 is a front view of the clamshell package of FIG. 1.
Figure 3:
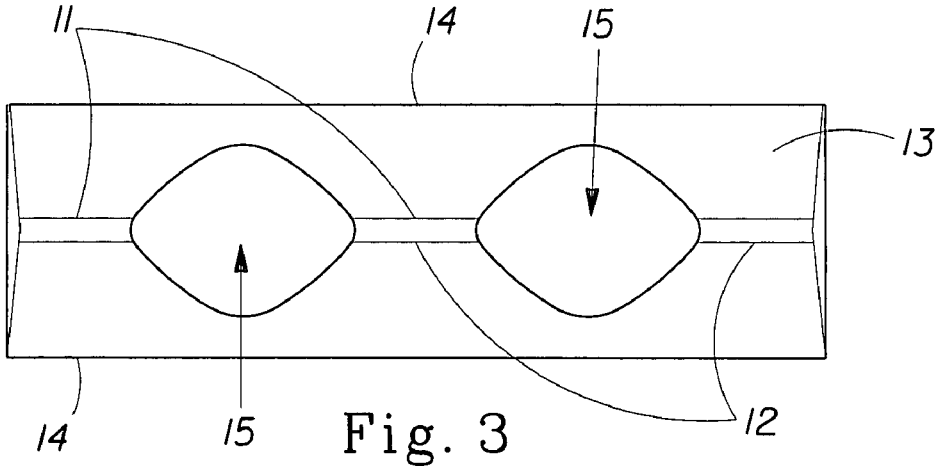
FIG. 3 is a bottom view of the clamshell package of FIG. 1.
Figure 4:
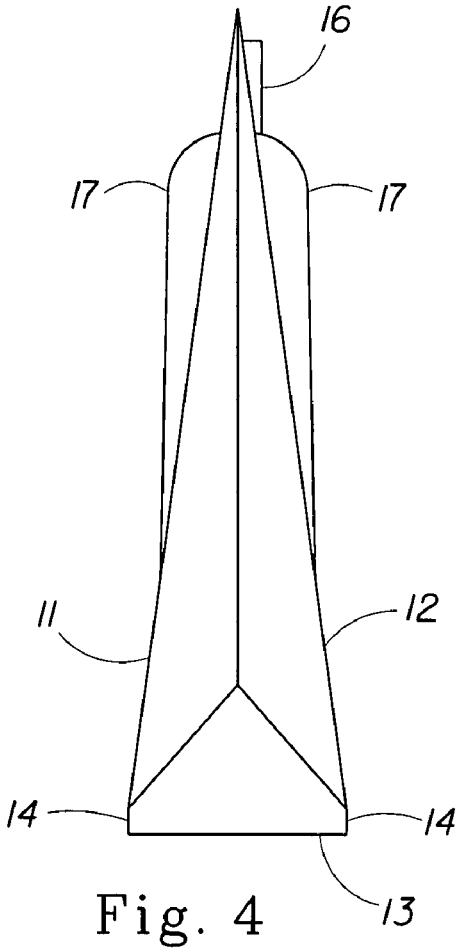
FIG. 4 is a side view of the clamshell package of FIG. 1.

As used herein, the term "clamshell" is intended to include thermoform packages typically referred to as clamshell packages or blister pack packages. The term "clamshell package" as used herein therefore encompasses blister pack packages.

As used herein, the term "tottle" means a bottle having a cap attached to the bottle, wherein the bottle is designed to rest on its cap. Many shampoos, hair conditioners, shaving lotions, body washes, in-shower body moisturizers, and other products used in the shower or bath are contained in tottles.

In one aspect of the present invention, the clamshell package comprises a first clamshell side and a second clamshell side, wherein at least a portion of the first and second clamshell sides are affixed together to hold the consumer product between the first and second clamshell sides. The sides of the clamshell package can be affixed together by a number of processes or materials known in the art, such as heat-sealing, adhesive sealing, or by friction, for example through the use of locking tabs that are friction-fitted by connecting a male aspect to a female aspect.

The clamshell package preferably further comprises an aperture through which at least a portion of the cap of the consumer product extends from the clamshell package. The cap can be a flip-top cap, screw-on cap, snap-on cap, and the like. Preferably, the cap is a flip-top cap which allows a consumer to easily flip open the cap to smell or otherwise interact with the consumer product, without having to open the clamshell package.

Preferably at least one side of the clamshell package has a recess area that is molded to receive the bottle, or tottle, of the consumer product to be held and displayed in the clamshell package. The bottle, or tottle, of the consumer product is typically made of a plastic material. Examples of suitable plastic materials include high density polyethylene ("HDPE"), low density polyethylene ("LDPE"), polyethylene terephthalate ("PET"), polypropylene ("PP"), polyvinyl chloride, polycarbonate, nylon, and fluorinated ethylene propylene. The bottle can be made via a number of various processes known in the art, such as blow molding, injection molding, and the like. Preferred bottles of the present invention are made of HDPE or PP via an extrusion blow molding process, or PET via an injection blow molding process.

The clamshell package of the present invention is typically made of a thermoplastic material. Examples of thermoplastic materials include acrylonitrile butadiene styrene (ABS), acrylic, celluloid, cellulose acetate, ethylene vinyl alcohol (E/VAL), fluoroplastics (PTFEs, including FEP, PFA, CTFE, ECTFE, ETFE), ionomers, liquid crystal polymer (LCP), polyacetal (POM or Acetal), polyacrylates (Acrylic), polyacrylonitrile (PAN or Acrylonitrile), polyamide (PA or Nylon), polyamide-imide (PAI), polyaryletherketone (PAEK or Ketone), polybutadiene (PBD), polybutylene (PB), polybutylene terephthalate (PBT), polyethylene terephthalate (PET), polycyclohexylene dimethylene terephthalate (PCT), polycarbonate (PC), polyketone (PK), polyester, polyethylene/polythene/polyethene, polyetheretherketone (PEEK), polyetherimide (PEI), polyethersulfone (PES), polyethylenechlorinates (PEC), polyimide (PI), polymethylpentene (PMP), polyphenylene oxide (PPO), polyphenylene sulfide (PPS), polyphthalamide (PPA), polypropylene (PP), polystyrene (PS), polysulfone (PSU), polyvinyl chloride (PVC), and mixtures thereof. Preferred thermoplastic materials herein include polyvinyl chloride, polyethylene terephthalate, and polypropylene. The thermoplastic material is preferably a transparent material, especially transparent polyvinyl chloride.

A second aspect of the present invention relates to a clamshell package that holds and displays a consumer product comprising a tottle. In this aspect, the clamshell package preferably does not comprise any apertures and the first and second sides of the clamshell package are affixed together, preferably by a method that forms a seal such as heat-sealing, such that any composition that may leak from the tottle will be contained in the clamshell package and prevented from leaking onto a shelf in a retail store. Although this embodiment does not facilitate consumer interaction with the product, it does provide the benefit of preventing leakage of the product onto shelves in a retail store.

In one embodiment of the present invention, the clamshell package is a tri-fold clamshell package comprising a first side, a second side and a base portion. The base portion is attached to the first side by a first hinge and to the second side by a second hinge. The first and second sides, and optional base portion, of the clamshell package can be made from a single continuous piece of thermoplastic material, or can be made from separate pieces of thermoplastic materials that are then heat-sealed or otherwise affixed together.

The clamshell package can optionally further comprise a hole through one or more sides of the package to facilitate hanging of the package from a display hook in a retail store.

The clamshell packages of the present invention can be utilized to hold and display a variety of personal care products, such as shampoos, hair conditioners, shaving lotions, body washes, in-shower body moisturizers, and the like. Non-limiting examples of shampoos are described in U.S. Pat. Nos. RE 34,584, 5,932,203, and 5,935,561. Non-limiting examples of hair conditioners are described in U.S. Pat. Nos. 4,387,090 and 4,705,681. Non-limiting examples of shaving lotions are described in U.S. Pat. Nos. 5,248,495, 5,451,396, and 6,682,726. Non-limiting examples of body washes are described in U.S. Pat. Nos. 5,885,948, 6,080,707, and 6,194,364. Non-limiting examples of in-shower body moisturizers are described in U.S. Pat. No. 6,699,488, U.S. Pat. No. 6,645,511, US 2003/0049282 A1, and US 2003/0054019 A1.

The clamshell packages of the present invention can be utilized to hold and display a variety of household care products, such as dishwashing detergents, laundry detergents, fabric softeners, fabric refresher sprays, and the like.

In one embodiment, the present clamshell package holds and displays a consumer product having a multi-phase visual product appearance. These types of products tend to comprise at least two phases, wherein the phases are visually distinct and form a pattern, such as swirled, striped, marbled, or other geometric patterns. Non-limiting examples of consumer products having visually distinct phases are described in US 2004/0057920 A1 and US 2004/0092415 A1. A clamshell package made of a transparent thermoplastic material is especially suitable for holding and displaying such consumer products exhibiting a visual pattern since the appearance of the product can be observed by the consumer on a 360° basis.

In one embodiment, the consumer product held and displayed by the present clamshell package is a scented consumer product; in other words, the consumer product comprises perfume.

The clamshell package of the present invention can further comprise a label comprising indicia such as graphics, words, logos, trademarks, or the like, affixed to the clamshell package or such indicia can be printed directly onto the clamshell package, especially for advertising or promotional purposes.

The clamshell package of the present invention can hold and display a plurality of consumer products. For example, the clamshell package can be used to hold and display two consumer products, which could be the same or different products, especially for promotion and sale in warehouse-type retail stores, otherwise known as club stores, which tend to sell consumer products in bulk or in larger quantities as compared to more traditional retail stores. The clamshell package can also be used to hold and display complementary consumer products, for example: a shampoo product and a hair conditioner product; a liquid body wash product and a skin moisturizer lotion product; a liquid laundry detergent and a fabric softening product. When the clamshell package holds a plurality of consumer products, the clamshell package will comprise a plurality of apertures through which the caps of the consumer products extend, so that consumers can interact with each of the consumer products in the clamshell package.

One embodiment of the present invention is illustrated in FIGS. 1-6. The clamshell package 10 of FIGS. 1-6 is designed to hold and display two tottles 18, each tottle 18 containing a scented liquid personal care product, such as body wash or shampoo.

The clamshell package 10 shown in FIGS. 1-4 is the clamshell package itself, without showing the tottles 18 of the consumer products that are intended to be held and displayed therein. In this embodiment, the clamshell package 10 is a trifold clamshell package comprising a first clamshell side 11, a second clamshell side 12 and a base portion 13. The trifold clamshell package 10 is constructed from a single piece of transparent polyvinyl chloride. The base portion 13 is attached to the first clamshell side 11 and the second clamshell side 12 by two hinges 14. The base portion 13 further comprises two apertures 15, through which the caps 19 of the tottles 18 extend, once the tottles 18 are placed into the clamshell package 10. The first clamshell side 11 and second clamshell side 12 are folded together at each hinge 14, relative to the base portion 13. The first clamshell side 11 and second clamshell side 12 are affixed together via a number of locking tabs 16, which are friction-fit locking tabs. A male aspect of each locking tab 16 is molded into the first clamshell side 11 and a female aspect of each locking tab 16 is molded into the second clamshell side 12. The first clamshell side 11 and second clamshell side 12 each comprise a recess area 17. Each recess area 17 is molded to the shape of the tottles 18 to be held and displayed by the clamshell package 10.

Figure 5:
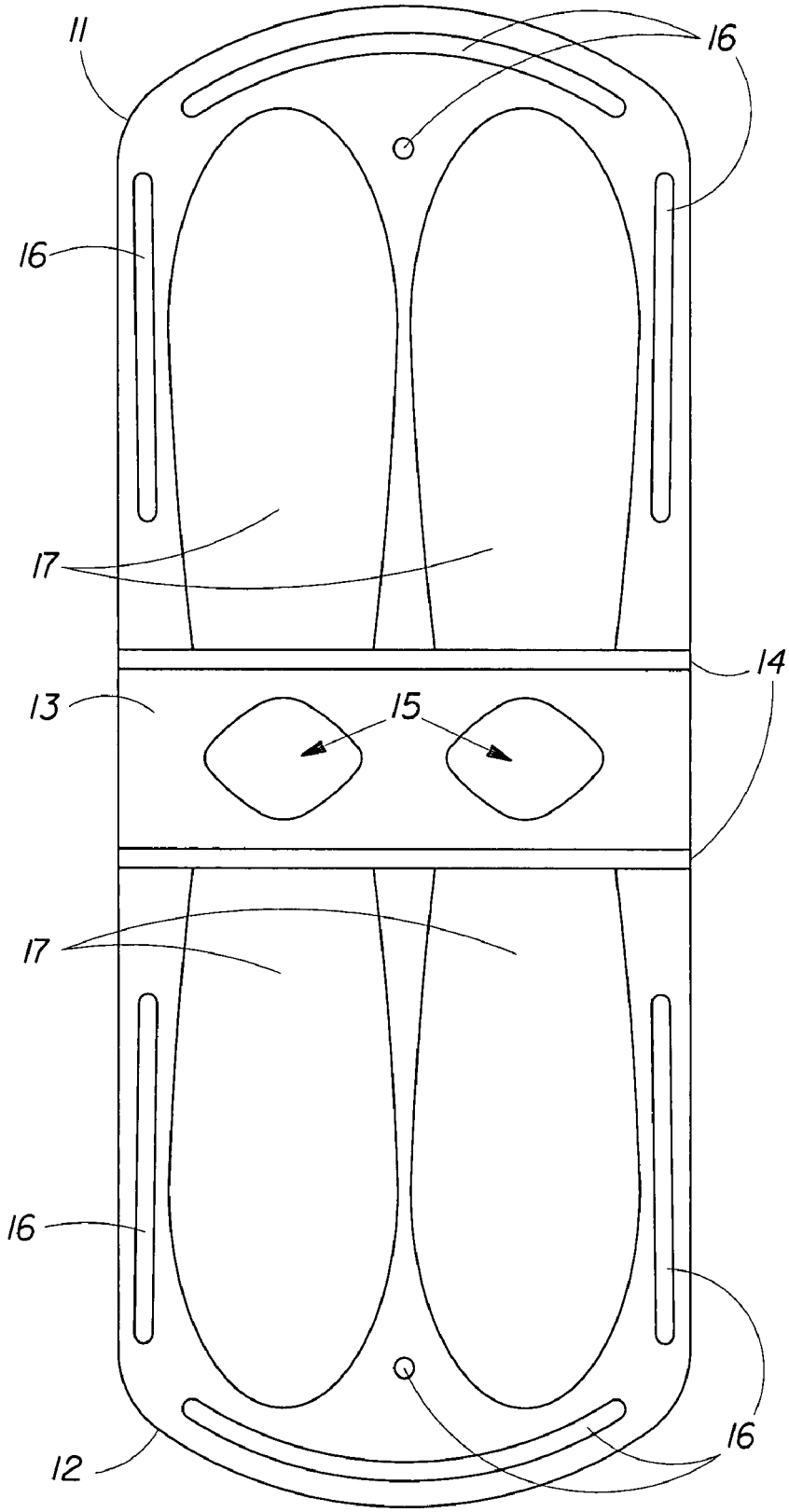
FIG. 5 is a plan view of a template of the clamshell package of FIG. 1 made from a single piece of thermoplastic material, before folding the first and second clamshell sides of the clamshell package together.

A template of the clamshell package 10 made from a single piece of transparent polyvinyl chloride is shown in FIG. 5, before the first clamshell side 11 and second clamshell side 12 are folded together along the hinges 14 relative to the base portion 13 to form the clamshell package 10.

Figure 6:
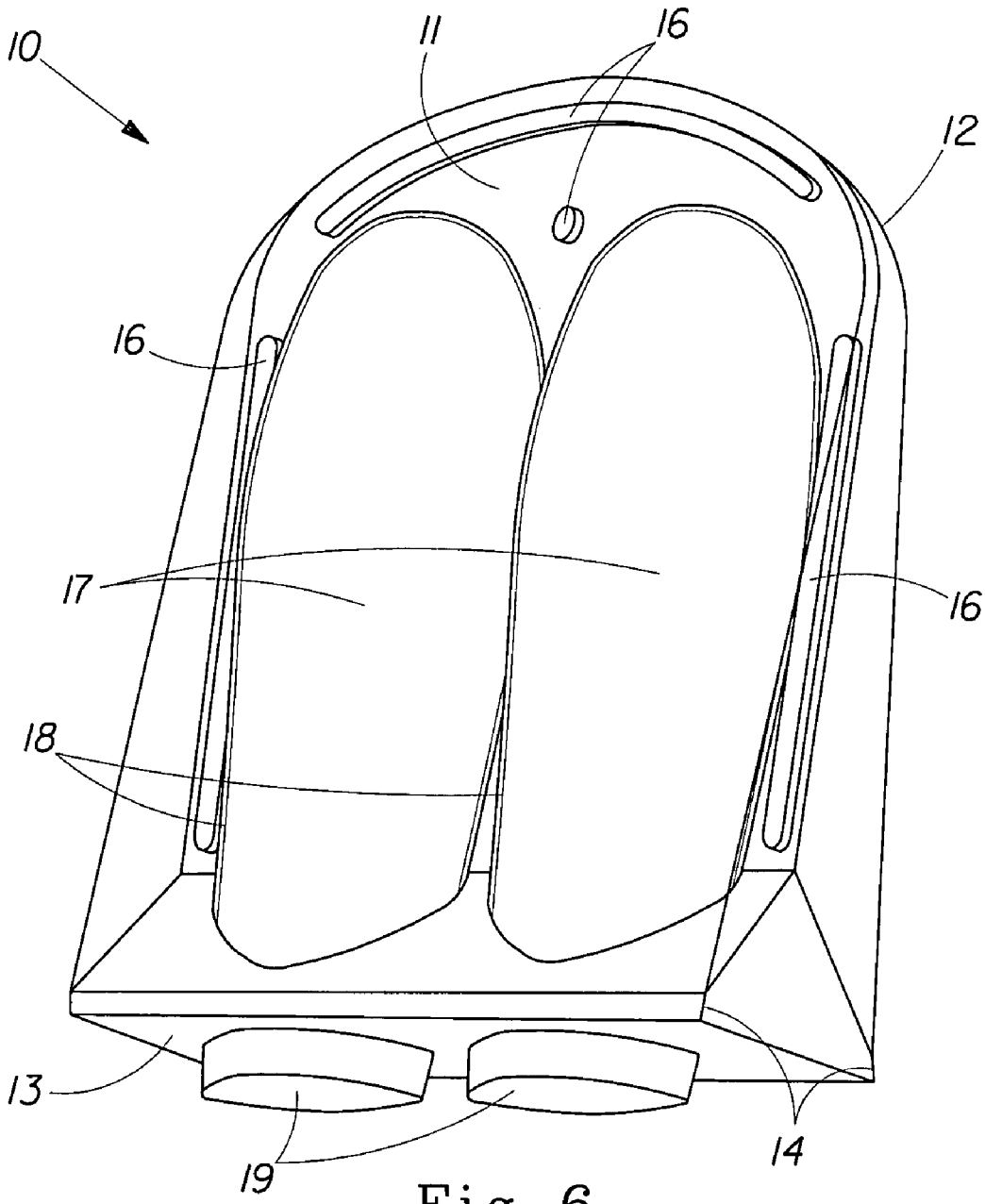
FIG. 6 is a perspective view of the clamshell package of FIG. 1 holding and displaying two consumer products, each consumer product comprising a tottle.

FIG. 6 illustrates the clamshell package 10 of FIGS. 1-4 that is holding and displaying two tottles 18, with each tottle 18 having a cap 19. Each tottle 18 is held between the first clamshell side 11 and second clamshell side 12, in the corresponding recess areas 17. Each tottle 18 has a cap 19 which extends through an aperture 15 in the base portion 13. As a result, each cap 19 is accessible outside the clamshell package 10, while each tottle 18 is held within the clamshell package 10 in the recess areas 17. Each cap 19 is a flip-top cap. A consumer can therefore flip open the cap 19 of each consumer product in order to smell or otherwise interact with the product contained in the tottle 18. The clamshell package 10 can then be stored on a shelf in a retail store by resting the clamshell package 10 on the caps 19 of the tottles 18.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A clamshell package for holding and displaying a consumer product comprising:

a bottle;

a cap connected to said bottle;

a first clamshell side having a first recess area;

a second clamshell side having a second recess area, wherein at least a portion of said first and second clamshell sides are affixed together to define a bottle holding volume defined by the first and second recess areas, wherein said bottle holding volume is sized to hold said bottle within said first and second recesses of each of said first and second clamshell sides, and wherein said bottle holding volume has a shape similar to said bottle;

a top formed where the first and second clamshell sides are affixed together;

a base portion extending between the first and second clamshell sides; and an aperture through the base portion through which at least a portion of said cap of said bottle extends from said clamshell package, wherein a first end of said recess area is at least partially enclosed between said first and second clamshell sides at the top and a second, opposite end of said bottle holding volume is in communication with said aperture at the base portion;

wherein said cap is a flip-top cap having an openable portion that is exposed beyond said clamshell package to allow a consumer to flip open said openable portion with the bottle located in the bottle holding volume.

2. The clamshell package of claim 1, wherein said cap can be opened without opening said clamshell package.

3. The clamshell package of claim 1, wherein said bottle comprises a scented composition housed therein.

4. The clamshell package of claim 3, wherein said scented composition is a multi-phase scented composition comprising a first phase and a second phase, wherein said first phase and said second phase form a visual pattern.

5. The clamshell package of claim 3, wherein said scented composition is a body wash.

6. The clamshell package of claim 1, wherein said bottle is a tottle.

7. The clamshell package of claim 1, wherein said clamshell package holds and displays a plurality of bottles.

8. A clamshell package for holding and displaying a consumer product comprising:

a bottle having a first shape;

a cap connected to said bottle;

a first clamshell side;

a second clamshell side, wherein at least a portion of said first and second clamshell sides are affixed together at an edge overhanging the bottle with the bottle in an upright, standing position on the cap, the first and second clamshell sides defining a bottle holding volume therebetween, wherein said bottle holding volume is sized to hold said bottle within a recess of each of said first and second clamshell sides, wherein said bottle holding volume has a second shape, and wherein said second shape is the same as said first shape of said bottle;

a base portion opposite the edge comprising an aperture, wherein said base portion is attached to said first and second clamshell sides by hinges adjacent to said base portion, and wherein at least a portion of said cap of said bottle extends from said clamshell package through said aperture of said base portion; and wherein a first end of said bottle is at least partially enclosed between said first and second clamshell sides and a second, opposite end of said bottle with said cap extends outwardly from said clamshell package;

wherein said aperture extends about an entire periphery of said cap at a location spaced from an end of said cap to provide access to said cap for opening said cap without opening said clamshell package; and wherein said cap is a flip-top cap having an openable portion that is exposed beyond said clamshell package to allow a consumer to flip open said openable portion.

9. The clamshell package of claim 8, wherein said bottle comprises a scented composition housed therein.

10. The clamshell package of claim 9, wherein said scented composition is a multi-phase scented composition comprising a first phase and a second phase, wherein said first phase and said second phase form a visual pattern.

11. The clamshell package of claim 10, wherein said scented composition is a body wash.

12. The clamshell package of claim 8, wherein said bottle is a bottle.

13. The clamshell package of claim 12, wherein said cap provides a base configured to support said clamshell package in an upright, standing position.

14. The clamshell package of claim 8, wherein said clamshell package holds and displays a plurality of bottles.

15. The clamshell package of claim 1, wherein the first and second clamshell sides are affixed together at the top at an edge that is unsuitable for supporting the bottle in an upright, standing position.

* * * * *